United States Patent [19]

Bergkvist et al.

[11] Patent Number: 4,503,918

[45] Date of Patent: Mar. 12, 1985

[54] ROCK DRILLING APPARATUS

[75] Inventors: Hans Bergkvist, Ecublens; Hans Jaun, la Conversion, both of Switzerland

[73] Assignee: Institut Cerac S.A., Ecublens, Switzerland

[21] Appl. No.: 504,988

[22] Filed: Jun. 16, 1983

[30] Foreign Application Priority Data

Jun. 22, 1982 [SE] Sweden ..... 8203865

[51] Int. Cl.[3] ..... E21B 44/00; E21C 5/10

[52] U.S. Cl. ..... 175/27; 175/51; 173/9

[58] Field of Search ..... 173/3–6, 173/9, 19, 57, 163; 175/27, 24, 51, 67, 171, 215, 257, 173; 91/318, 356, 433

[56] References Cited

U.S. PATENT DOCUMENTS

| | | | |
|---|---|---|---|
| 2,856,157 | 10/1958 | Chapin et al. | 175/323 |
| 3,155,171 | 11/1964 | Kurt et al. | 175/27 |
| 3,420,323 | 1/1969 | Owens | 175/323 |
| 3,561,542 | 2/1971 | Hanson | 173/5 |
| 3,835,943 | 9/1974 | Bray | 175/173 |
| 4,064,950 | 12/1977 | Salmi et al. | 173/9 |
| 4,275,793 | 6/1981 | Schivley, Jr. et al. | 173/9 |

FOREIGN PATENT DOCUMENTS

| | | | |
|---|---|---|---|
| 482911 | 12/1969 | Switzerland | 175/173 |
| 594259 | 2/1978 | U.S.S.R. | 175/67 |

*Primary Examiner*—James A. Leppink
*Assistant Examiner*—Hoang C. Dang
*Attorney, Agent, or Firm*—Eric Y. Munson

[57] ABSTRACT

A rock drilling apparatus for drilling with high pressure hydraulic jet including a rock drill body (11), a drill tool (12) coupled to said body (11) and a feeding device (15) with a motor (16) for feeding said body and tool to and fro the working face. The drilling tool (12) has an inner rotating tube (40) with a high pressure nozzle body (41) at the nose thereof and an outer tube (42) surrounding said inner tube (40). Said outer tube (42) is provided with a hard metal collar (61) at the front end for protecting the nozzle body (41) and for calibration of the drill hole size. A sensing device including a pressure operated switch 73 and an adjustable time relay (83) is adapted for sensing the feed resistance met by said collar (61) and causing said feed motor (16) to retract said drill body (11) and tool (12) when a preset value of the resistance is exceeded.

10 Claims, 7 Drawing Figures

ROCK DRILLING APPARATUS

This invention relates to a rock drilling apparatus for drilling holes by means of high pressure hydraulic jet including a rock drill body, a drilling tool attached to said rock drill body, and a feeding device with a motor for feeding said body and tool to and fro the working face, said rock drilling tool incorporating an inner rotating rod with a high pressure nozzle body at the nose thereof and an outer non-rotating tube surrounding said inner rod, said rock drill body being provided with a means for supplying high pressure hydraulics to said nozzle and a rotating mechanism for rotating said inner tube.

Drilling apparatus of the kind described above are known which have a power feed device for example a feed leg. The feed device brings a certain thrust to the drilling tool which thrust is chosen by experience of the rock quality in order to continuously advance the tool into the drill hole. If the advancing rate is chosen too high the expensive drill nozzle will abut against the working face of the drill hole and get damaged. On the other hand if the tool is advanced too slow the drilling capacity will be unsufficiently profiled. But also when the tool is fed with a speed chosen low enough for being on the safe side the nozzle might hit harder fractures in the rock and get stopped until the operator observes the stoppage. But before that the nozzle might be damaged or an unwanted chamber cut out in the rock.

An object of the present invention is therefore to provide a jet drilling apparatus which avoids the above drawbacks of the known apparatus and which calibrates the size of the drill hole and maximizes the penetration speed.

This object and others are achieved by providing a jet drilling apparatus according to the accompanying claims.

The invention will now be described more in detail referring to the accompanying drawings, in which.

Figure 1:
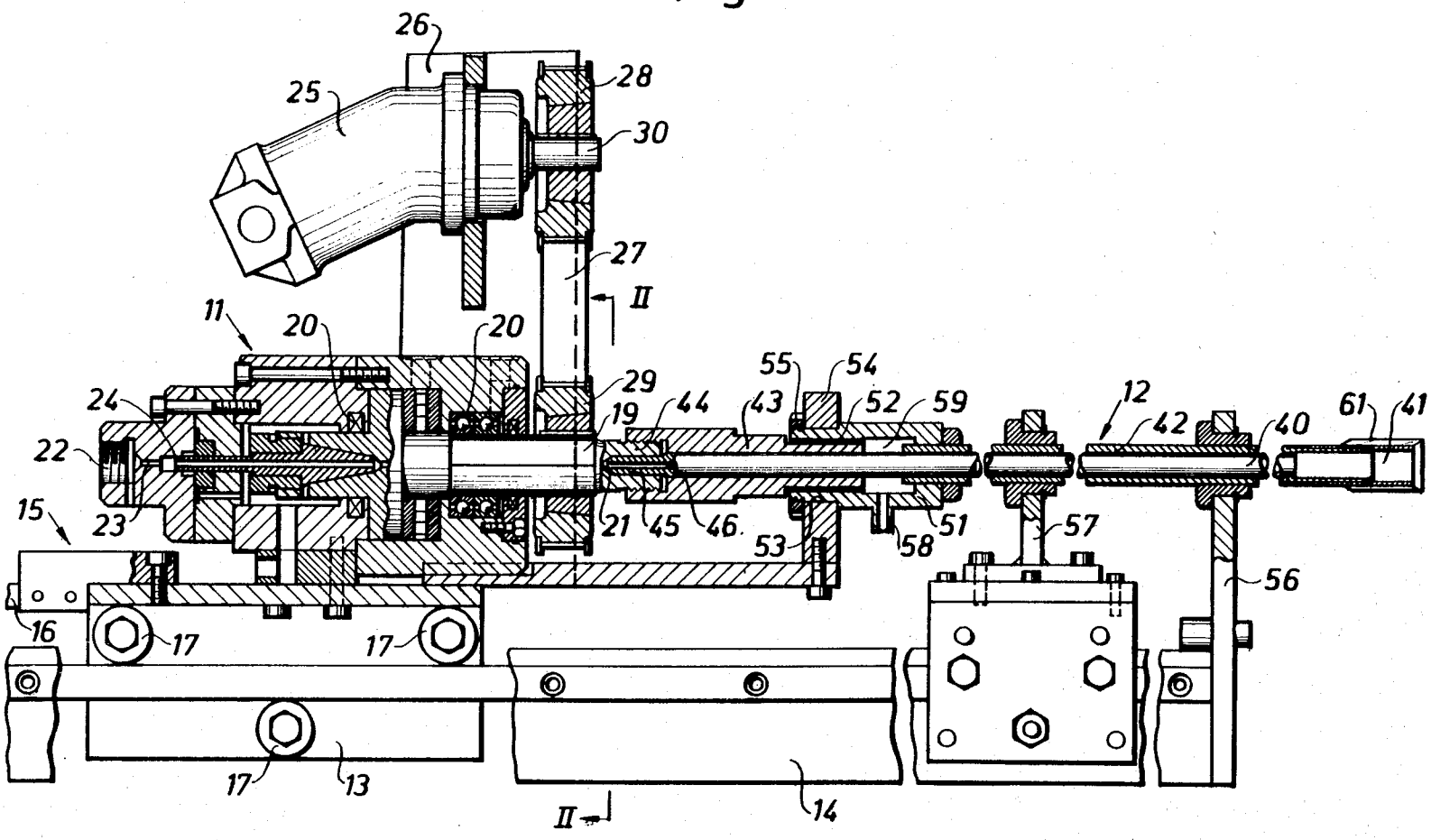
FIG. 1 is a side view partly in section of a drilling apparatus according to the invention.
Figure 2:
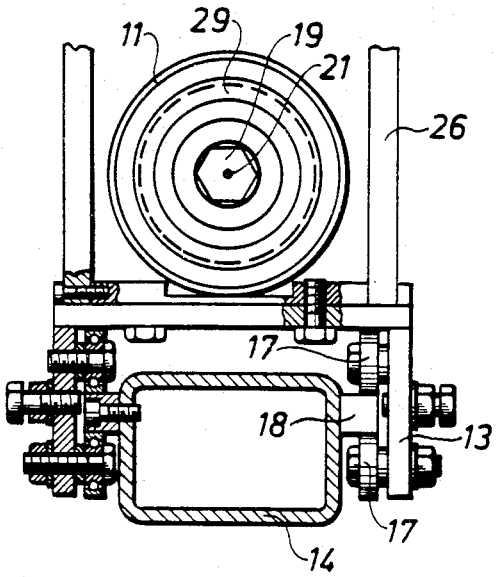
FIG. 2 is a cross section taken along the line 2—2 in FIG. 1.

The shown embodiment includes a rock drill body 11 with a jet drilling tool 12 connected thereto. The drill body 11 is mounted on a cradle 13 which is displaceable along a feed beam 14 by means of a feeding device 15. Said feed beam 14 is attached to positioning means, not shown, including a swinging arm carried by a movable chassis in a manner previously known from conventional rock drilling. The feeding device 15 comprises a hydraulic cylinder and piston arrangement of which only a part of the piston 16 is shown. There is also possible to use other suitable feeds including a hydraulic motor. The cradle 13 is carried on rolls 17 which run on guide bars 18 in the feed beam 14.

The drill body 11 contains a rotating shaft 19 journalled on bearings 20 and comprising a longitudinal bore 21 for leading high-pressure hydraulic fluid to the drilling tool 12. The fluid is led into the drill body from an external high pressure pump, not shown, by an inlet 22 and a passage 23 into which one end 24 of the shaft 19 is sealingly inserted. A hydraulic motor 25 is held by a stand 26 mounted to the cradle 13 and is arranged for rotating said shaft 19 by means of a timing belt 27 laid over belt wheels 28, 29 on the motor shaft 30 and the rotating shaft 19 respectively.

Figure 4:
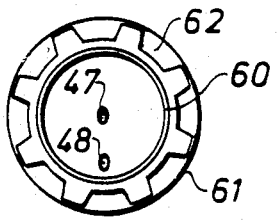
FIG. 4 is a front side view seen from the line 4—4 in FIG. 3.
Figure 3:
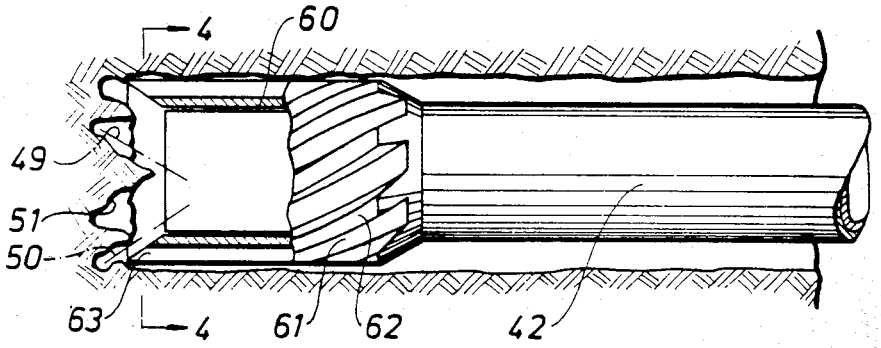
FIG. 3 is a side view of the nose of the drilling tool partly in section and in an enlarged scale shown in a drill hole.

The jet drilling tool 12 comprises an inner rotating tube 40 with a high pressure nozzle body 41 at the nose thereof and an outer non-rotating tube 42 surrounding said inner tube. The rear end of the inner tube 40 is provided with a threaded sleeve 43 for connection with the front end 44 of the rotating shaft 19. A projecting part 45 of the inner tube 40 is inserted into the bore 21 for making a suitable connection for the distribution of high pressure liquid from the bore 21 into the tube 40. The liquid is led through the interior 46 of the tube 40 to the nozzle body 41 which contains two nozzles 47, 48 (FIG. 4) at the front end for forming the hydraulic jets 49, 50 which brake the rock at the working face 51. The rear end of the outer tube 42 comprises a tube head 51 welded thereto. Said tube head 51 is provided with a recess 52 fitting into a hole 53 of a drill holder 54 which is mounted to the cradle 13. The head 51 is demountably secured to said holder 54 by a ring 55 threaded on said recess 52. Also other suitable coupling means can be used for non-rotatably connecting the outer tube 42 to the drill holder 54. The drill tool 12 is guided by a forward drill support 56 attached to the feed beam 14 and a middle support 57 deplaceable along the beam 14.

The tube head is provided with an inlet 58 and an annular chamber 59 for leading low pressure flushing medium preferably water into an annular spacce 60 between the tubes 40,42 and further around the nozzle body 41 out to the nose of the tool. By this arrangement there will be easy to accomplish a sufficient flush flow and a minimum of cuttings will penetrate into the space 60 between the rotating nozzle body 41 and the tube 42 which keeps the wear down. The front part of the outer tube 42 comprises a collar 61 for calibration of the drill hole size during drilling operation. The collar 61 is provided with spiral grooves 62 on the outside to allow the drill cuttings to flow backwards and still maintain circular calibration. The spiral shape will also make it easier to eliminate minor projecting rock parts in the hole by shearing them off when the non-rotating collar advances. The front end of the collar 61 has a V-cut edge 63 for allowing the jet 50 to flow towards the periphery of the hole.

Figure 5:
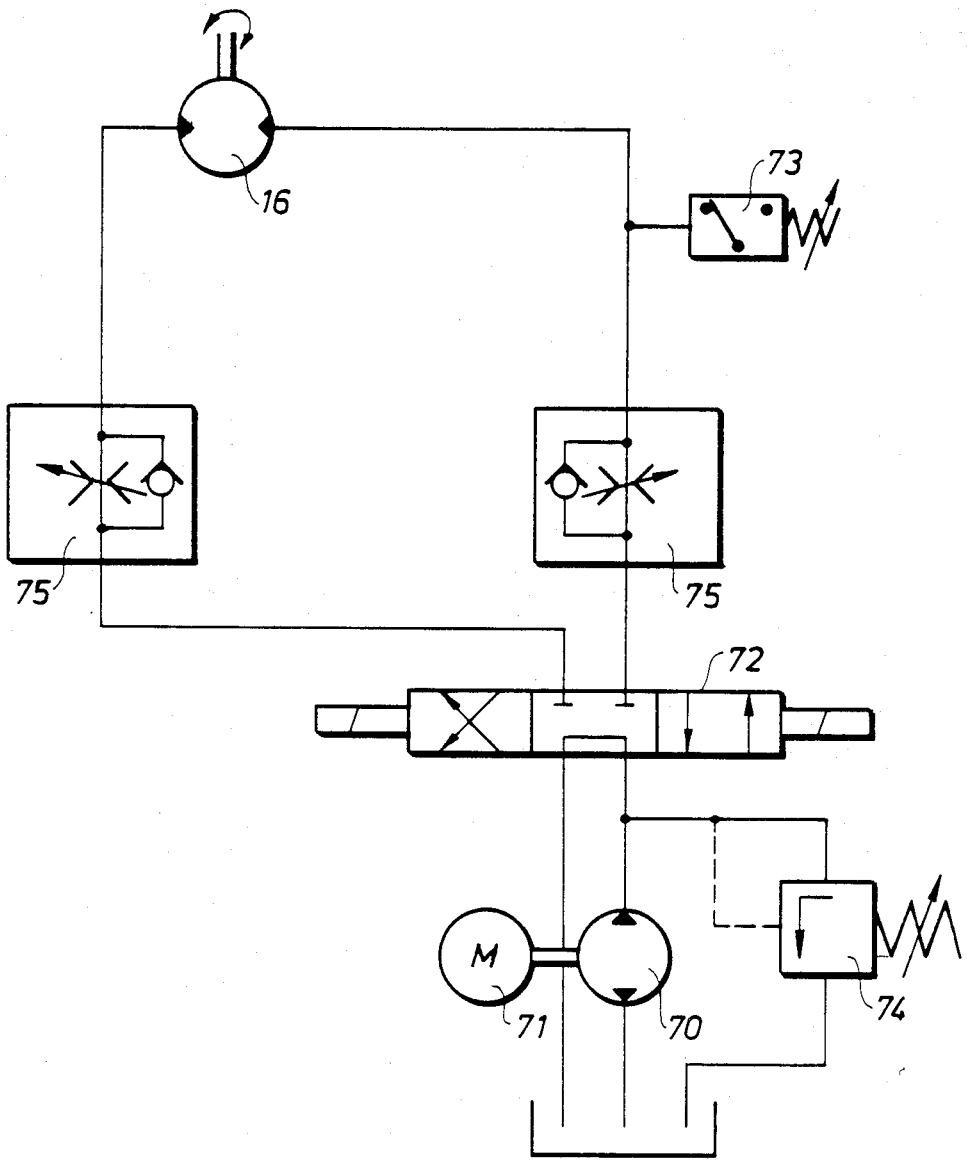
FIG. 5 is a schematic diagram of a hydraulic circuit including the feed motor.

The feeding device 15 comprises as mentioned a hydraulic motor 16 which might be a rotary motor or a cylinder and piston motor. The hydraulic system for driving said motor appears from FIG. 5 and includes in addition to said motor 16 a pump 70 with a driving motor 71, a directional control valve 72 and a pressure operated switch 73 of any known suitable kind for example Telemecanique XM2-JM160 or Rexroth HED 40 AIX/50. A sequence valve 74 with variable pressure is coupled in parallel with the pump 70 and a combination 75 of throttle valve and non-return valve with variable throttling is arranged on each side of the feed motor 16. The feeding direction and the feeding speed is operated by the control valve 72 which in its advancing position according to the right symbol feeds the tool 12 forwards towards the working face and in its retracting position according to the left symbol retracts the tool. When the tool is fed forwards the applied hydraulic pressure is sensed by the switch 73 and if the pressure rises over a preset value the switch changes over and the control valve 72 is electrically switched to the left position whereby the tool is retracted.

Figure 6:
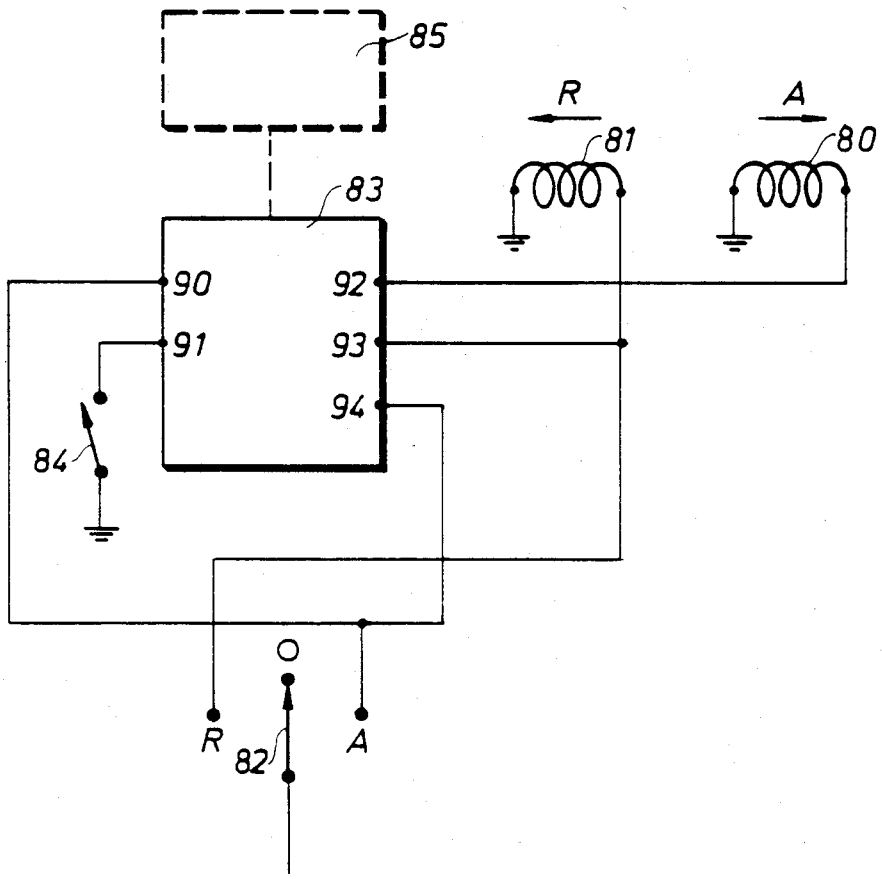
FIG. 6 is a schematic diagram of an electric circuit for operating the feed motor.
Figure 7:
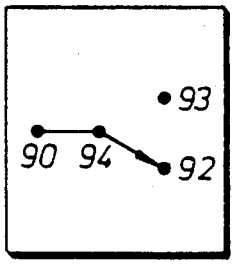
FIG. 7 is a detail of the circuit in FIG. 6.

The electric control of the valve 72 is shown more in detail in FIG. 6. The valve 72 is electromagnetically operated by a first coil 80 and a second coil 81 which are selectively activated by a manually operated main switch 82 connected to a source of current, not shown. When advancing the drilling tool 12, the switch 82 is set in the position A whereby a terminal 90 and a terminal 94 of an adjustable time relay 83 are set under tension. Said relay can be of any known suitable kind for example Nordela RS 121 or Sprecher and Schuh RZEW2-03 with delaying time intervals of about 0.05–1 second. A terminal 92 connected to the first coil 80 is also set under tension as seen from FIG. 7 which brings the valve 72 to take its advancing position. If the hydraulic pressure rises over said preset value the sensing switch 73 closes which changes the contact between terminal 94 and 92 to a contact between terminal 94 and 93 for a preset time interval. Now the first coil is disconnected and instead the second coil is set under tension which brings the valve 72 to take its retracting position. When said time interval has expired the sensing switch 73 opens again and the control valve 72 returns to its advancing position. The main switch 82 has also a position O and a position R for placing the control valve 72 in its neutral and retracting position respectively. The time relay is disconnectable by connecting terminal 92 to earth with a manual control 84.

During operation of the drilling apparatus the feeding speed is set in relation to the rock quality in order to get a drill hole somewhat wider than the size of the collar 61. Since the rock seldom is of homogenous quality the set speed can only be a rough approximation preferably determined so that the softest expected rock parts will be drilled with a hole size not too much wider than the collar. When the drilling tool reaches harder rock parts eg. a hard inclusion the collar abuts against the rock face and the hydraulic pressure in the feeding device starts to rise. Minor obstructions will be cut off by the spiral-groove arrangement as previously described but bigger ones will cause the pressure to rise over the pre-set limit of the sensing device 73 and the feeding device starts to retract the drilling tool as also previously described. The time interval for said retractive motion is adjustable within 0.05–1 second for adapting to different drilling conditions. When said time interval has come to an end the tool advances again and if the jets 49, 50 which have been continuously flowing have removed the obstacles, the drilling continues but if the obstacles remain the procedure repeats until the hole is clear.

As an alternative to said delaying time interval there is also possible to determine the action of the control valve 72 as function of the retract distance as picked, for example, directly on the hydraulic motor. A further possibility is to combine parameters of time and distance.

Another alternative is to dynamically adjust the time intervals or the retracted distances by a micro-processor 85, schematically shown in FIG. 6, working as a tuning element minimizing some combination of the retraction cycles and the sum of the retracted distances so as to give optimum advance rate. The system should ideally work so that the drilling tool advances without reverse motion, since all retraction cuts back the net advance rate, but as fast as possible.

It is to be noted that the invention is not limited to the described embodiment but can be varied in many ways within the scope of the accompanying claims.

We claim:

1. A rock drilling apparatus for drilling holes by means of a high pressure hydraulic jet including a rock drill body (11), a drilling tool (12) attached to said rock drill body (11), and a feeding device (15) including a motor (16) for moving said body and tool to and from a working face, said drilling tool (12) comprising an inner rotating tube (40) provided with a high pressure nozzle body (41) at the nose thereof and an outer tube (42) surrounding said inner tube (40), said rock drill body (11) being provided with means (19, 22, 23) for supplying high pressure hydraulics to said nozzle body (41) and a rotating mechanism (25,27) for rotating said inner tube (40), characterized by a sensing device (73) for sensing the resistance met by said outer tube (42) while moving to said working face and effective to cause said motor (16) to retract said drill body (11) and tool (12) from said working face when a preset value of said resistance is exceeded; said sensing device comprising relay means (83) effective to maintain said drill body and said tool in the retracted position for a preselected interval and to cause said motor to move said drill body and said tool to said working phase upon the expiration of said preselected interval.

2. An apparatus according to claim 1, characterized in that the outer tube (42) has a larger cross section than the nozzle body (41) for calibration of the drill hole size.

3. An apparatus according to claims 1 or 2, characterized in that the outer tube (42) comprises a calibrating collar (61) at the front end thereof said collar (61) extending ahead of the nozzle body (11).

4. An apparatus according to claim 3, characterized in that the collar (61) comprises spiral grooves (62) on the outside thereof.

5. An apparatus according to claim 1, characterized by coupling means (55,58) for holding the outer tube (42) non-rotatably connected to the drill body (11) and for introducing low pressure flushing fluid between said inner tube (40) and said outer tube (42).

6. An apparatus according to claims 1, 2 or 5, characterized in that said hydraulic power means (19, 22, 23) include a hydraulic circuit directional control valve (72) for driving said feed motor (16), and that said sensing device (73) is adapted for sensing the pressure in said circuit in order to switch over the valve (72) from a tool advancing position to a tool retracting position when the pressure exceeds a preset level.

7. An apparatus according to claim 1, characterized in that said sensing device (73) is effective to retract said drill body and said tool a preselected distance from said working surface and that said relay means (83) is effective to move said drill body and said tool to said working surface upon reaching said preselected distance.

8. An apparatus according to claim 1, characterized in that said relay means is an adjustable time relay (83).

9. An apparatus according to claims 1 or 8, characterized by controller means (85) for dynamically adjusting said selected interval during the drilling operation.

10. An apparatus according to claim 8, characterized in that said controller means (85) is a micro-processor working as a tuning element minimizing a combination of the frequency of said retraction cycles and the sum of the retracted distances for achieving an optimum advance rate.

* * * * *